United States Patent [19]

Neiman

[11] Patent Number: 4,614,450

[45] Date of Patent: Sep. 30, 1986

[54] PORTABLE INDEX CARD HOLDER FOR NOTEBOOKS

[76] Inventor: Rhoda Neiman, 2212 California Ave., Santa Monica, Calif. 90403

[21] Appl. No.: 541,543

[22] Filed: Oct. 13, 1983

[51] Int. Cl.[4] ..... B42F 7/00; B42F 17/20

[52] U.S. Cl. ..... 402/79; 402/80 P; 281/31; 40/124.2; 40/537

[58] Field of Search ..... 281/31; 402/79, 80 R, 402/80 P; 40/124.2, 404, 537

[56] References Cited

U.S. PATENT DOCUMENTS

| | | | |
|---|---|---|---|
| 1,111,981 | 9/1914 | Walker, Jr. | 40/124.2 |
| 2,610,421 | 9/1952 | Horn | 40/537 |
| 3,735,516 | 5/1973 | Wenstrom | 40/124.2 X |
| 3,837,106 | 9/1974 | Lofstrom et al. | 40/124.2 X |
| 3,852,903 | 12/1974 | Buco | 40/537 X |

FOREIGN PATENT DOCUMENTS

| | | | |
|---|---|---|---|
| 0852227 | of 1928 | Australia | 40/124.2 |
| 2458355 | 6/1976 | Fed. Rep. of Germany | 40/124.2 |
| 2546635 | 4/1977 | Fed. Rep. of Germany | 40/124.2 |
| 2658821 | 10/1978 | Fed. Rep. of Germany | 281/31 |
| 0759518 | 10/1956 | United Kingdom | 40/124.2 |

*Primary Examiner*—Robert L. Spruill
*Assistant Examiner*—Taylor J. Ross
*Attorney, Agent, or Firm*—John E. Kelly

[57] ABSTRACT

A portable index card holder is designed for carrying in notebooks or simply carrying by itself. The holder comprises a flexible member approximately the size of a notebook page having secured to its front surface a plurality of transparent sheets in an overlapping array between the top and bottom of the supporting member. These transparent sheets each includes small strip overlays defining front and rear pockets for receiving and supporting the lower marginal edge of an index card in such a manner that any one card can easily be inspected by simply lifting up the sheets above the same. The transparent feature permits reading both the front and rear sides of an index card without having to remove the same from the transparent sheet and holding member. Further, several such members can readily be inserted in a notebook such as a 3-ring binder for organizing many different cards in conjunction with other items.

3 Claims, 3 Drawing Figures

PORTABLE INDEX CARD HOLDER FOR NOTEBOOKS

FIELD OF THE INVENTION

This invention relates generally to portable filing and storage systems to facilitate organization of various business items such as calling cards, accounting receipts, information bearing index cards and the like and more particularly, to an index card holder for such notebooks.

BACKGROUND OF THE INVENTION

Organizing files in the form of notebooks, albums, and the like are well known in the art. Generally such file systems will include notebook-like structures having hard panel faces with numerous pockets and the like formed on the inside for storing various documents. In addition, most such organizing systems include holders for conventional index cards wherein a plurality of such cards can be held in a confined space and any one or more of the cards easily removed and replaced. In such systems, marginal portions of a card held in such a device are visible so that any specific card can readily be identified and then the entire card reviewed by removing the same from the holder.

Such holders for index cards as are presently available are normally of a permanent type kept at a secretarial desk and mounted on a vertical panel. The holders themselves usually comprise a fairly stiff material having a pocket along its lower edge into which the lower edge of a business card or an index card can be slipped. To read the rear of the card, it is normally necessary to remove the card from the particular holder.

Several such holders as described above can be provided in a vertical array, the major portions of the area of each holder overlapping the next successive holder.

It is known to construct photographic albums in a similar manner wherein transparent pockets will hold pictures, several such picture-holding devices being arranged in a vertical array in overlapping relationship. Any one picture can be examined by lifting up the picture holding pockets above the particular picture to be examined.

Notwithstanding the existence of the above-described filing systems, there still exists a need for a simple portable index card holding device which can either be inserted into a notebook containing other pockets for storing and organizing articles or can be easily separated from the notebook for convenient carrying by itself. In addition, there is a need in such an index card carrying device for enabling both sides of a card to be easily and quickly examined without having to remove the card from the particular holder.

BRIEF DESCRIPTION OF THE PRESENT INVENTION

With the foregoing in mind, the present invention contemplates the provision of a greatly improved portable index card holder designed for use with a notebook.

Briefly, the holder comprises a support member having means along at least one marginal edge for securing the member in a notebook. At least one transparent horizontally disposed rectangular sheet of dimensions larger than an index card is provided. This transparent sheet is secured as by a heat seal along its top marginal length to an area of the member having a given width in such a manner that the sheet can be turned upwardly, the heat seal functioning as a hinge. The assembly is completed by provision of a folded strip of a length corresponding to the longitudinal length of the sheet defining a V-shape in cross section straddling the bottom edge of the sheet. Opposite ends of this strip are heat sealed so as to define front and rear pockets for receiving index cards. A single card received in either the front pocket or the rear pocket can have both sides readily examined without having to remove the card in view of the transparency of the sheet involved.

A plurality of such card holders in the form of transparent sheets can be provided in overlapping relationship along a vertical direction between the top and bottom of the holding member.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
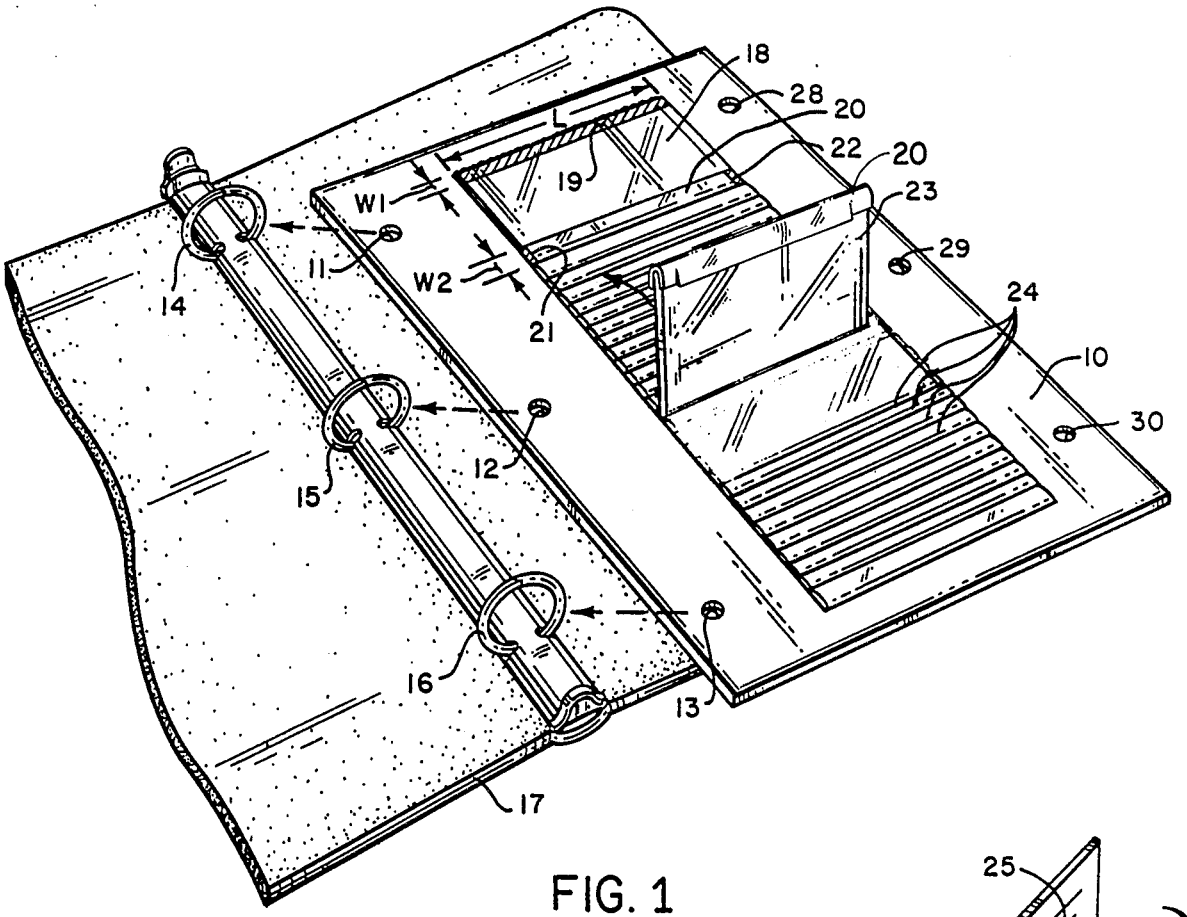
FIG. 1 is a perspective view of the portable index card holder of this invention preparatory to being received in a ring binder type notebook.

Referring first to FIG. 1, the holder of the present invention includes a support member 10 which may either be stiff or flexible. Support member 10 includes along one marginal edge appropriate means for securing the member in a notebook. In the example shown for illustrative purposes, this means takes the form of holes 11, 12 and 13 positioned to receive the rings 14, 15 and 16 respectively of a ring binder type notebook 17.

As shown in FIG. 1, there is provided at least one transparent, horizontally disposed rectangular sheet 18 of dimensions larger than an index card. This sheet is heat sealed by appropriate heat seal means 19 extending along the top marginal length of the sheet over the distance indicated by the letter L to the support member 10. The marginal area of the top margin of the sheet 18 in contact with the support member 10 has a width indicated at W1 in FIG. 1. This width W1 is sufficiently small that it is very simple for a person to turn the sheet 18 upwardly in such a manner that the heat seal 19 functions as a hinge.

A folded strip 20 of a length corresponding to the longitudinal length L of the sheet and of a second given width W2 defines a V-shape in cross section straddling the bottom edge of the sheet 18. This structure will become clearer as the description proceeds. The opposite ends of the strip 20 are heat sealed as at 21 and 22.

Several identically formed transparent sheets to the sheet 18 described may be provided so that a plurality of transparent sheets are supported on the support member 10. The numeral 23 illustrates an arbitrarily selected sheet being turned upwardly so as to expose the underside of the sheet so that any index card inserted on the top will have its rear side visible when the transparent sheet is turned upwardly. 24 represents a plurality of additional such sheets forming a vertical array between the top and bottom of the support member 10.

Figure 2:
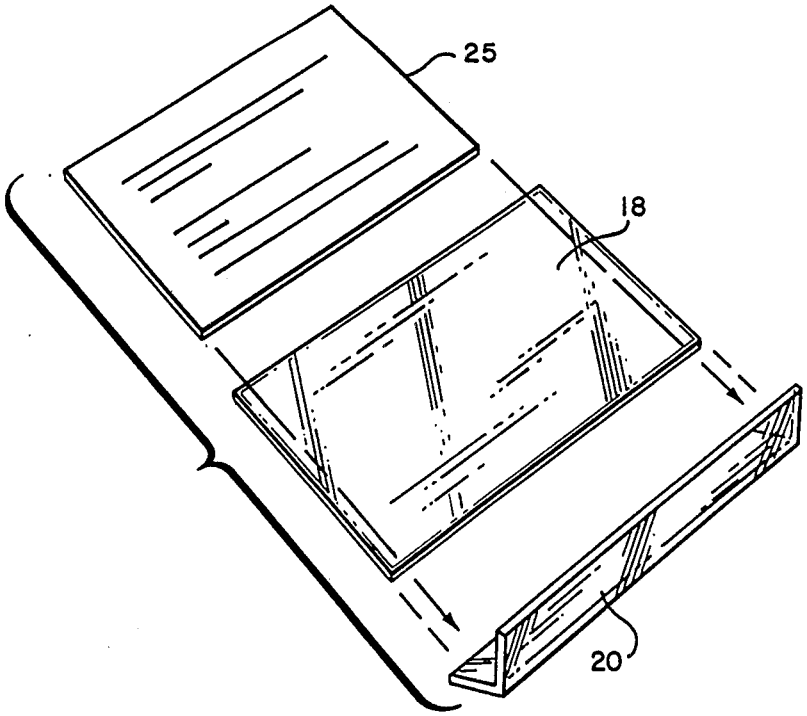
FIG. 2 is an enlarged exploded perspective view showing the basic components of the card holder with an index card illustrated; and, FIG. 3 is another exploded view with the components making up the card holder in assembled relationship and the index card itself shown exploded away therefrom.

Referring now to FIG. 2, further details of the sheet construction described briefly in FIG. 1 will become evident. As shown in FIG. 2, the V-shaped strip 20 is exploded away preparatory to receiving the bottom marginal edge of the transparent sheet 18. Also shown is an index card 25 exploded away from the sheet 18 in an opposite direction.

Figure 3:
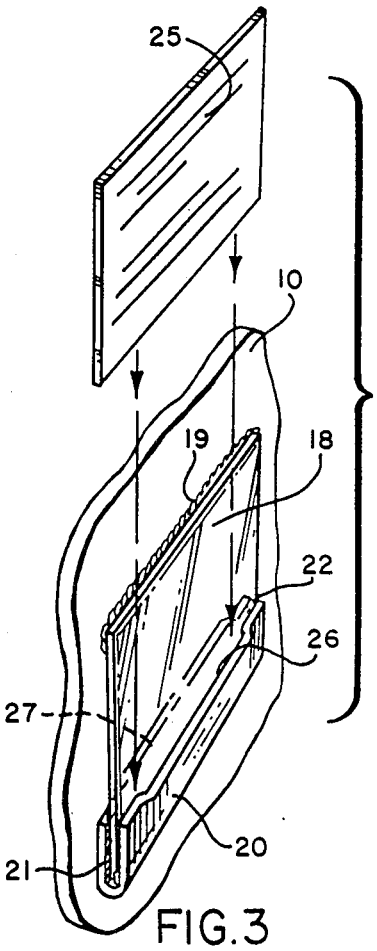

Referring to FIG. 3, there is shown a portion of the support member at 10 to which the sheet 18 has had its top marginal edge heat sealed again indicated at 19. Also, the V-shaped strip 20 is shown fully positioned on the lower end of the transparent sheet 18, the opposite ends of the strip being heat sealed as described and again indicated by the numerals 21 and 22.

Front and rear pockets as a consequence of the end heat sealing of the strip 20 are defined at 26 and 27 so that index cards such as the card 25 can be received therein.

Referring once again to FIG. 1, as described heretofore, the numeral 24 represents a plurality of additional transparent sheets identical to sheet 18 heat sealed along their top longitudinal edges at equally vertically spaced longitudinally extending areas at a central portion of the support member 10 between the top and bottom edges of this member. The value of the vertical spacing between successive sheets is between the first given width W1 and the second given width W2. By this arrangement, there will be enough of the lower edge of each transparent support sheet and strip 20 exposed from the overlying strip so that an index card inserted therein can be readily identified by appropriate coding on its lower end.

The described structure is extremely simple and can be manufactured simply as a combination of the support member 10 and the various transparent sheets heat sealed thereon. Alternatively the entire notebook 17 with ring binder and a plurality of support members such as indicated at 10 containing transparent sheets for holding index cards could be provided and sold as a unit. Normally the organizing file would best be provided in this latter form; that is, there would be provided a plurality of support sheets 10 each carrying a plurality of transparent sheets for holding index cards. If a user then needed only the cards on one support member such as the member 10 described in FIG. 1, that member could be removed from the ring binder without disturbing the others and taken for the particular purpose at hand. Later on, it could be reinserted in the notebook.

It will be noted in FIG. 1 that the right hand margin of the support member 10 is provided with ring binder holes 28, 29 and 30. These holes are optional and are used to permit the support member with the holders to be inserted in the right hand side of the notebook upside-down. When in the up-side-down position, headings or coding may be placed across the top end rather than the bottom end of each card holder, it being understood that the cards would be inserted in proper orientation for viewing by folding back of the next successive holder.

Of course the support member 10 could be place in an up-side-down postion on the left side of the notebook without having to provide the additional holes, the original holes 11, 12 and 13 serving to secure the same in the notebook.

The index card holders are not limited in size to conventional index cards. They can be designed to hold large or small cards or other items such as recipies and the like.

It should be understood that while holes and rings have been shown for securing the support member 10 in a notebook, equivalent securing means such as additional flaps or the like tucked within formed pockets could be provided for so securing the support member in a notebook.

Other changes falling within the scope and spirit of this invention will occur to those skilled in the art. The portable index card holder for notebooks is therefore not to be thought of a limited to the one example set forth for illustrative purposes.

I claim:

1. A portable index card holder for a notebook including, in combination:

(a) a support member having means along at least one marginal edge for securing the member in a notebook;

(b) a plurality of transparent, horizontally disposed rectangular sheets each of dimensions larger than an index card;

(c) heat seal means extending along the top longitudinal lengths of said sheets at equally vertically spaced horizontal areas along a central portion of said member between the top and bottom holding a top marginal area of given width of each sheet to said member so that said sheet can be turned upwardly, said heat seal means functioning as a hinge;

(d) a folded strip of a length corresponding to the longitudinal length of each sheet and of a second given width defining a V-shape in cross section straddling the bottom edge of each sheet; and (e) heat seal means extending transversely at each end of said folded strip along its said second given width to secure the same to its corresponding sheet only at said ends whereby front and rear pockets are defined adjacent to the lower end of each side of each sheet for receiving an index card in each side, one index card received in the front pocket having its rear side visible through said sheet when the sheet is turned upwardly and any card in the rear pocket is removed.

2. A holder according to claim 1, in which said means along at least one marginal edge for securing the member in a notebook includes holes.

3. A holder according to claim 1, in which the vertical spacing between successive sheets has a value between said first given width and said second given width.

* * * * *